US009066584B2

(12) United States Patent
Li

(10) Patent No.: US 9,066,584 B2
(45) Date of Patent: Jun. 30, 2015

(54) WEATHER INTEGRATED CANE WORKSTATION

(76) Inventor: Nelson Anshy Li, North Potomac, MD (US)

( * ) Notice: Subject to any disclaimer, the term of this patent is extended or adjusted under 35 U.S.C. 154(b) by 258 days.

(21) Appl. No.: 13/528,594

(22) Filed: Jun. 20, 2012

(65) Prior Publication Data

US 2013/0074741 A1 Mar. 28, 2013

Related U.S. Application Data

(63) Continuation-in-part of application No. 13/317,878, filed on Oct. 31, 2011.

(60) Provisional application No. 61/626,963, filed on Oct. 6, 2011, provisional application No. 61/626,346, filed on Sep. 26, 2011.

(51) Int. Cl.

| | |
|---|---|
| ***A47C 7/62*** | (2006.01) |
| ***A47B 3/14*** | (2006.01) |
| ***A45B 3/00*** | (2006.01) |
| ***A45B 3/04*** | (2006.01) |
| ***A45B 5/00*** | (2006.01) |
| ***A47C 7/66*** | (2006.01) |
| *A47B 37/04* | (2006.01) |

(52) U.S. Cl.

CPC ... *A47B 3/14* (2013.01); *A45B 3/00* (2013.01); *A45B 3/04* (2013.01); *A45B 5/00* (2013.01); *A45B 2200/1018* (2013.01); *A45B 2200/1063* (2013.01); *A47C 7/66* (2013.01); *A47B 37/04* (2013.01)

(58) Field of Classification Search

USPC ..... 297/170, 171, 173, 174 R, 184.16, 160, 297/162

See application file for complete search history.

(56) References Cited

U.S. PATENT DOCUMENTS

| | | | | |
|---|---|---|---|---|
| 1,260,972 | A | 3/1918 | Faiella | |
| 4,318,567 | A | 3/1982 | Guthier | |
| D338,345 | S | 8/1993 | Camp | |
| 5,271,175 | A | 12/1993 | West, III | |
| 5,876,093 | A | 3/1999 | Williams | |
| 5,988,738 | A * | 11/1999 | Blessing et al. | 297/141 |
| 6,010,186 | A | 1/2000 | Tsay | |
| 6,234,187 | B1 | 5/2001 | Izzo | |
| D474,041 | S | 5/2003 | Howard et al. | |
| 6,601,865 | B1 | 8/2003 | Harper | |
| 6,899,388 | B1 | 5/2005 | Enrique | |
| 7,186,050 | B2 | 3/2007 | Dean et al. | |
| 8,439,055 | B2 | 5/2013 | April et al. | |
| 2003/0107246 | A1 | 6/2003 | Smyers | |
| 2006/0197362 | A1 | 9/2006 | Mabon et al. | |
| 2008/0121774 | A1 * | 5/2008 | Johnson | 248/311.2 |

* cited by examiner

*Primary Examiner* — David R Dunn
*Assistant Examiner* — Alexander Harrison
(74) *Attorney, Agent, or Firm* — Michael J. Foycik, Jr.

(57) ABSTRACT

A portable workstation can be folded so as to be readily portable as a cane, and has a seat portion and a table/tray portion for holding a book, electronic device, or lunch box, among other things. The workstation has a main leg pivotably connected to a pair of legs. An umbrella can be connected to the workstation in the folded condition of the workstation, and can be opened and adjustably positioned in the unfolded condition of the workstation. While outside, a user may need protection from the elements, such as from the sun, rain, sleet, or even snow, and can deploy the umbrella. Additionally, the umbrella can serve to prevent glare from electronic devices by shielding them from direct sunlight. A flashlight assembly can be plugged into the cane handle in a fixed orientation to provide light to the workstation table/tray when turned on.

2 Claims, 9 Drawing Sheets

WEATHER INTEGRATED CANE WORKSTATION

CLAIM FOR PRIORITY AND CROSS-REFERENCE TO RELATED APPLICATIONS

This application is a CIP of Ser. No. 13/317,878 filed Oct. 31, 2011, and also claims the priority of Provisional Patent Application Ser. Nos. 61/626,963, filed on Oct. 6, 2011 and Ser. No. 61/626,346 filed on Sep. 26, 2011.

STATEMENT REGARDING FEDERALLY SPONSORED RESEARCH OR DEVELOPMENT

Not applicable.

FIELD OF THE INVENTION

The present invention relates to a foldable workstation portable as a cane. The workstation is optionally useful as a chair or seating device with mountable umbrella component, useful for outdoor activities in all weather conditions. The present invention is in the technical field of furniture. More particularly, the present invention is in the technical field of workstations, foldable workstations with tray table and is portable as a cane, and all weather (including light after dark) workstations. The all-weather workstation can optionally be reduced to a portable all weather seating device by omitting a work-holding surface such as a table or tray portion and by omitting the flashlight assembly.

BACKGROUND OF THE INVENTION

At the pace of technological change, there is a great demand for portable workstations and workstation devices. In particular, there is a need for portable workstations which can be folded so as to be readily portable, having a seat portion and a table portion (with light after dark) for holding a book, electronic device, and papers, among other things. A number of workstation devices are known in the furniture and arts.

Examples of prior art patents relating to portable devices having a seat can be found in U.S. Design Pat. No. Des. 338,345 issued to inventor Camp for a collapsible seat; U.S. Design Pat. No. Des. 474,041 issued to inventors Howard et al. for a portable folding chair; and U.S. Pat. No. 6,899,388 issued to inventor Enrique for a portable chair and cane with umbrella.

It is a problem in the prior art to make workstation devices that would be portable and foldable, and easy to set up. Additionally, such workstation devices should be easy to collapse or fold, and should be easy to stow. Further, such workstation devices should have a work support tray, and should be stable in use, as well as lightweight.

Outdoor folding chairs are also well known, particularly those with flexible fabric seats which are cot-like in operation. However, such outdoor folding chairs are not adapted to serve as portable workstations.

None of the prior art devices are adapted to overcome the aforementioned deficiencies of the prior art. There is, therefore, a need in the prior art to provide a convenient, lightweight, portable workstation for outdoor use in all weather conditions and in dark, having a support such as a shelf or table (with light) portion. Further, there is a need in the prior art to provide such a portable workstation which can be used outdoors and which therefore additionally includes a sheltering device or sheltering portion for providing shelter for the user from the elements found outdoors, including sun, snow, rain and in dark.

In view of the aforementioned deficiencies and needs in the prior art, and in addition to the foregoing, it is also a problem in the prior art to provide a lightweight, foldable, and easy to use workstation having an umbrella mounted on a movable support, to provide shelter from the elements while outdoors.

It is a further problem in the art to provide a novel and useful construction of a foldable workstation device which overcomes the deficiencies of the prior art, including an improved construction, including improved pivot elements, a tray or table portion with lights and ratchet joints for adjustable positioning of a sheltering device such as an umbrella.

Further, it is a problem in the art to provide a convenient, lightweight, portable workstation which can be reduced to a chair by omission of a tray or table portion and the flashlight assembly, while also having a sheltering device or portion for providing shelter for the user from the elements found outdoors, including sun, snow, and rain.

SUMMARY OF THE INVENTION

From the foregoing, it is seen that it is a problem in the art to provide a device meeting the above requirements. According to the present invention, a device and process are provided which meets the aforementioned requirements and needs in the prior art. Specifically, the device according to the present invention provides a portable all weather workstation having a seat and table or tray portion with lights feature.

The present invention relates to workstations, and particularly portable and foldable workstations. In addition, the workstation of the present invention is optionally useful as a cane, and has a cane head.

Further, the workstation of the present invention can optionally be reduced to a portable seating device while also having a sheltering device or portion for providing shelter for the users specifically by omitting a work-holding surface such as a table or tray portion and the flashlight assembly.

In a preferred embodiment, the all-weather workstation includes an umbrella, a foldable seat and a foldable tray, and a flashlight assembly.

The workstation of the present invention also includes an adjustable umbrella. The umbrella can be mounted to the cane head by a ratcheting mount so that it can be set at a number of different angles, so as to provide protection from the sun or rain. The umbrella can be folded easily when not in use.

The workstation of the present invention also includes a flashlight component. The flashlight component is plugged in the cane head with a fixed angle. This angle is pre-adjusted to provide light to the foldable table or tray when it is in the open position.

Other objects and advantages of the present invention will be more readily apparent from the following detailed description when read in conjunction with the accompanying drawings.

DETAILED DESCRIPTION OF THE INVENTION

The present invention has four aspects, as follows. A first aspect of the present invention is as a portable workstation as shown in FIGS. 1-12, for use with electronics equipment such as tablet computers, intelligent phones, notebook computers and netbook computers, by way of example. Here, a table portion or tray portion provides support for the electronic device. The materials used for the workstation are very lightweight to render the workstation readily portable and stowable, and yet because of the inventive design the workstation of the present invention is sufficiently strong to provide durability.

A further feature of the inventive workstation is an adjustable positionable umbrella, which when used outdoors provides protection from the sun so that screen glare does not prevent use of the electronic devices. When used indoors, the umbrella portion can be positioned out of the way, or it can be entirely omitted or removed. The workstation of the present invention thus has the advantage of being usable both indoors and outdoors. The umbrella can be optionally used separate from the workstation.

A second aspect of the present invention is as a portable chair with a built-in option of protection from the weather elements. The construction is similar to that of the above-described workstation, with the table portion omitted, and is shown in FIGS. 13-16. This type of portable chair is useful for attendance at spectator events held outdoors such as sporting events, political and religious events held outdoors, and family functions held outdoors. It is also useful for hikers and tourists, who may need a break from their exertions as well as protection from sun or rain. The materials used for the workstation are very lightweight to render the workstation readily portable and stowable, and yet because of the inventive design the workstation of the present invention is sufficiently strong to provide durability.

Figure 1:
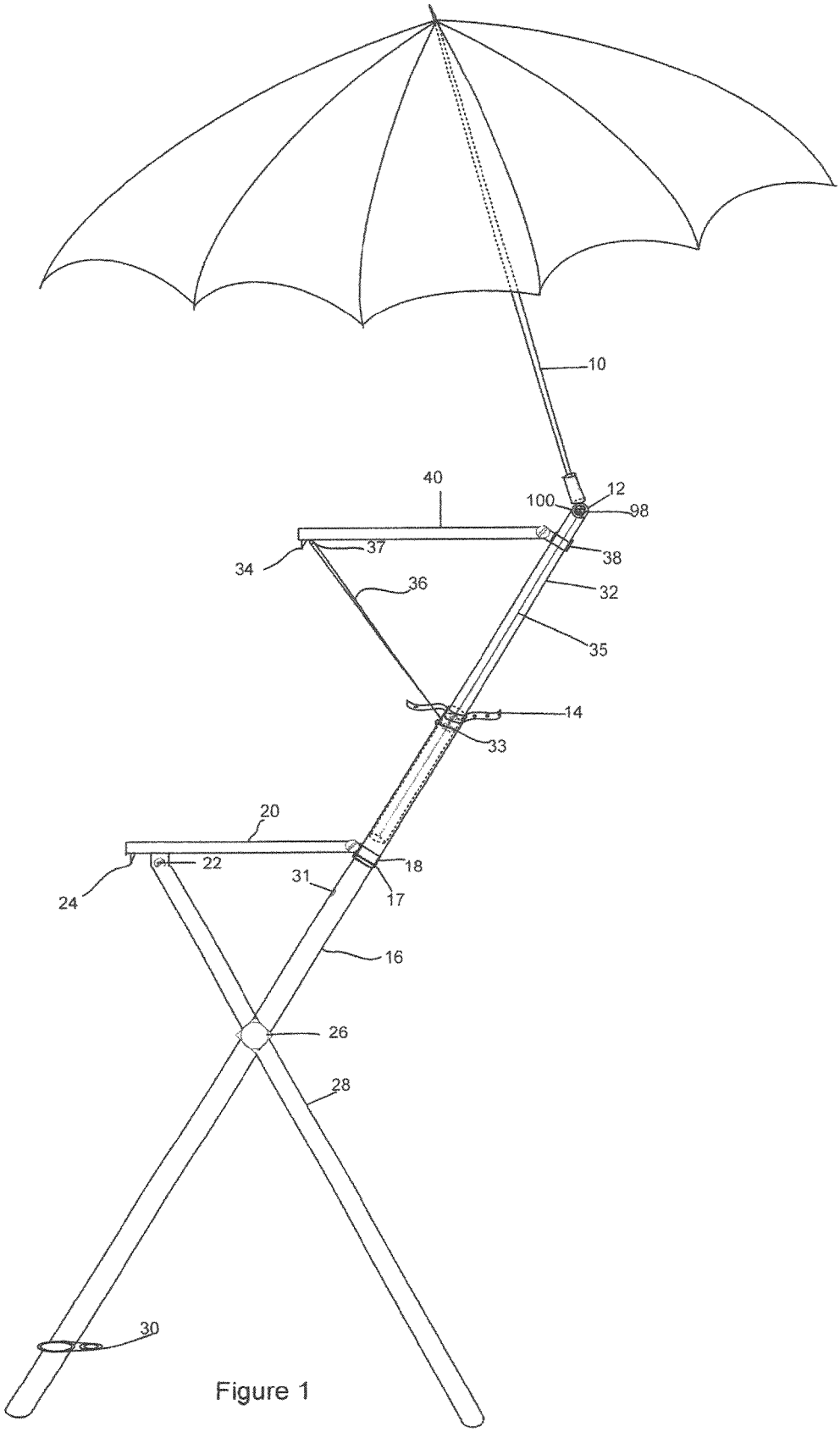
FIG. 1 is a side elevational view of the weather integrated cane workstation having a table, this view showing the left side of the weather integrated cane workstation in an operational position, according to the present invention.
Figure 4:
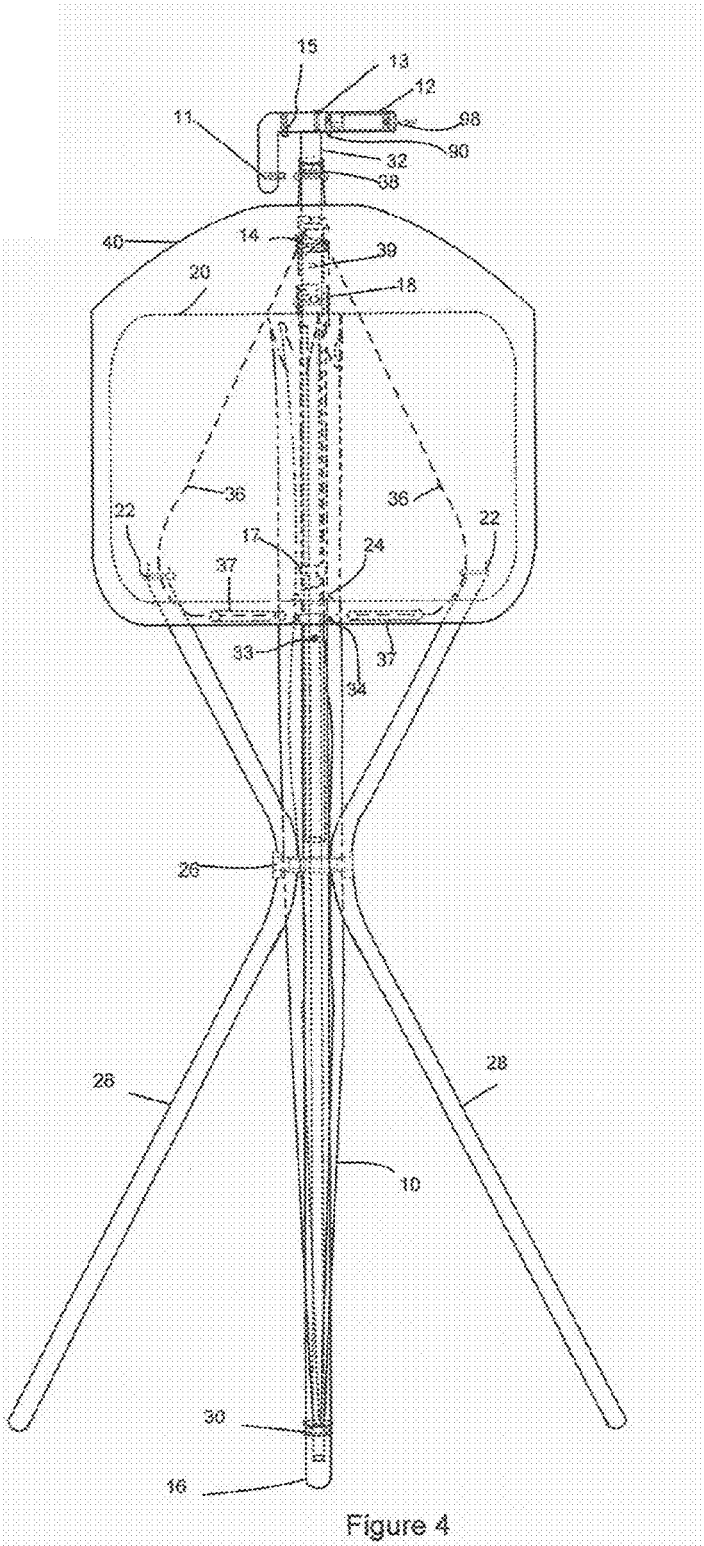
FIG. 4 is a front elevational view of the weather integrated cane workstation of FIG. 3, showing the weather integrated cane workstation in the folded condition.
Figure 13:
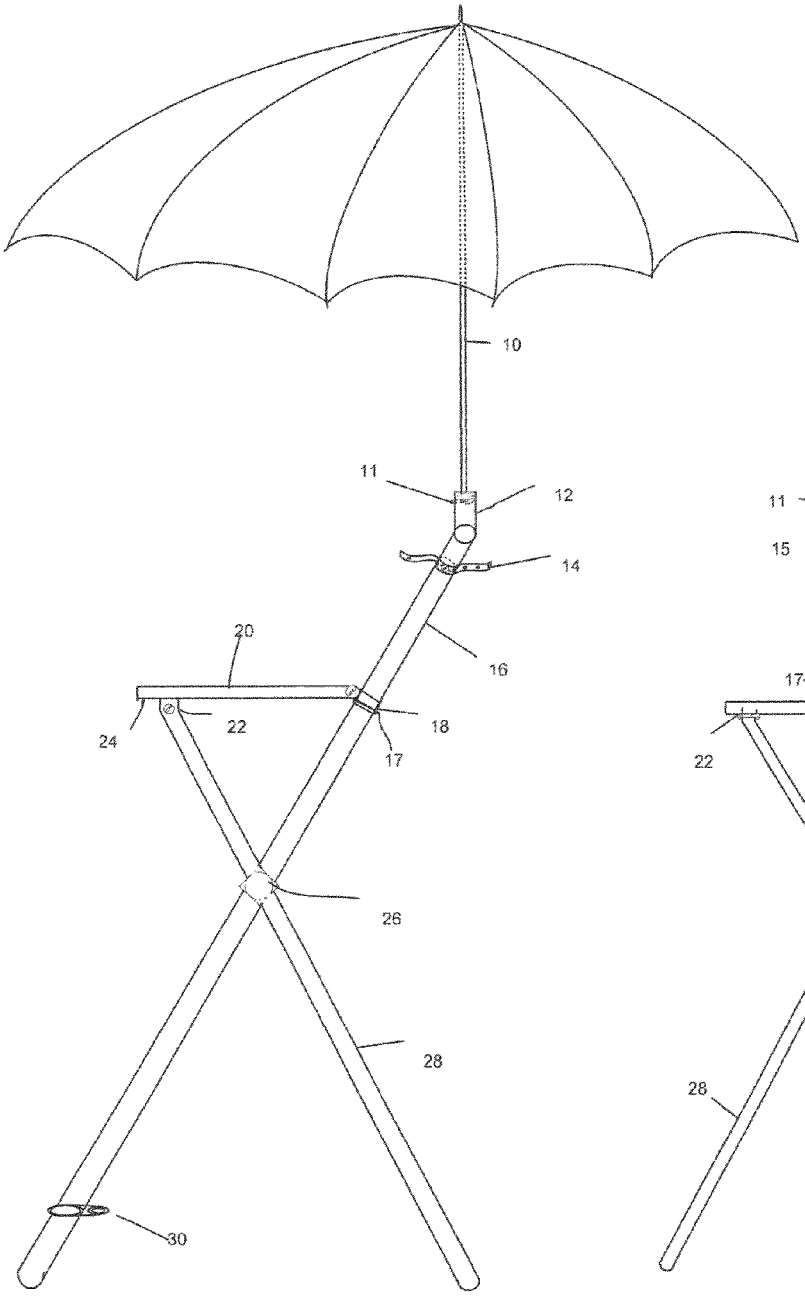
FIG. 13 is a side elevational view of the weather integrated cane chair similar to that shown in FIG. 1 hereinabove but without a table, this view showing the left side of the weather integrated cane chair in an operational position, according to the present invention.
Figure 16:
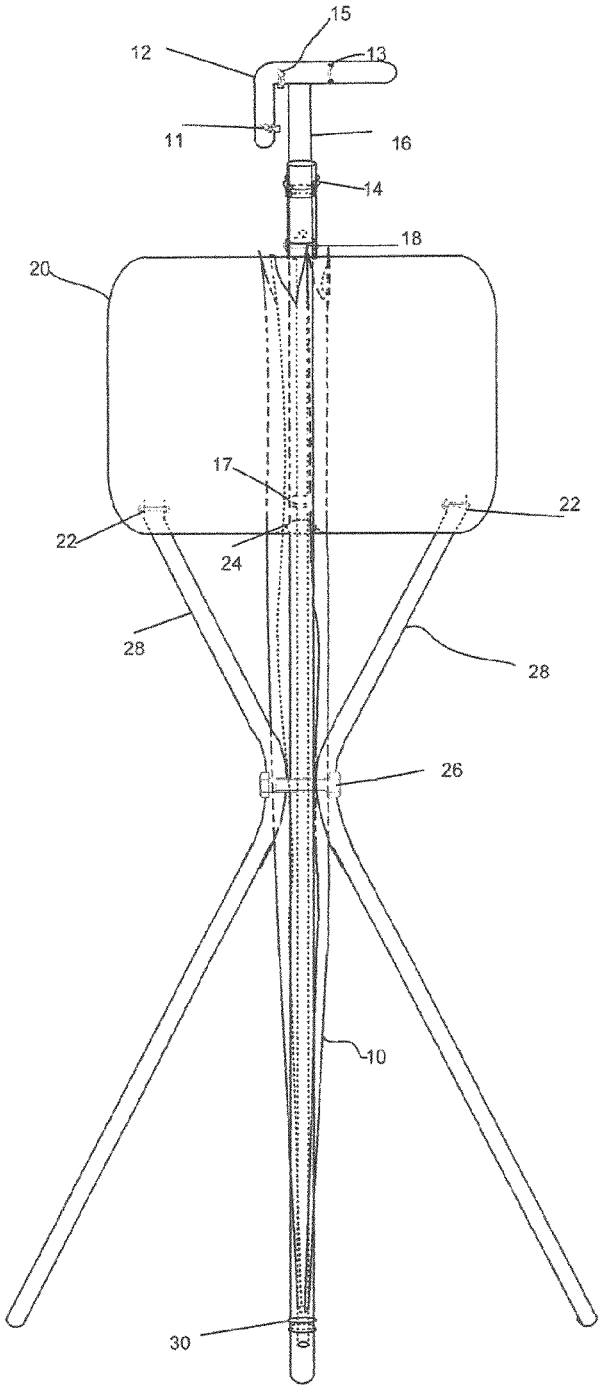
FIG. 16 is a front elevational view of the weather integrated cane chair of FIG. 15, showing the weather integrated cane chair in the folded condition.

A third aspect of the present invention is that it serves as a cane with a handle as shown clearly in FIGS. 4 and 16. This may be used by any individual. An individual carrying this cane may also need to be able to sit and rest during an outing or while taking a long walk, and so the cane of the present invention can be transformed into a seat as shown in FIGS. 1 and 13. While outside, the individual may need protection from the elements, such as from the sun, rain, sleet, or even snow. Thus, the cane of the present invention will be useful for attendance at spectator events held outdoors such as sporting events, political and religious events held outdoors, and family functions held outdoors.

A fourth aspect is an optional custom-designed flashlight component as shown in FIGS. 17-21. This component can be easily assembled and is plugged into the non-rotating part of the cane in a fixed angle by following a groove inside of the cane handle. The light shines through a fixed opening hole on the cane when the component is fully plugged in. The component is locked by a spring-biased push button when it is in correctly plugged-in position. It can be easily pulled out using the string at the end of the component while pushing the lock spring-biased push button to unlock the component. The light bubble takes advantages of the modern LED that can light up a large surface in a close range. The flashlight controlling parts provides a simple operation mechanism to turn the lights on and off by rotating a knob at the end of the assembly. When unlocked and pulled out, the flashlight assembly can be easily disassembled to replace battery or light bulb. The flashlight can be optionally used by itself with the light and handle in a 90 degree angle.

FIG. 1 is a side elevational view of a weather integrated cane workstation having a table portion 40, this view showing the side of the weather integrated cane workstation in an operational position. The operational position is the unfolded position, where a seat 20 is provided, and an umbrella 10 is available. A main leg 16 extends from the bottom to well beyond the seat 20 so as to provide a support for a lowermost tray support adjacent an umbrella tying portion 14; specifically, the table support is formed by a connecting device 38 and a triangular steel bar 36. The two ends of a steel wire or bar 36 are joined together to form the tip of the triangle. The ends then fan out after the joint and form a semicircular collar. When the tip end of device 36 rests on top of the push button 33, the collar will rest on the main leg 16 and will not allow sideways movement of table 40. Connecting device 38 is fixed to the table part bar 35. It does not allow any movement relative to bar 35.

The joint tip sits on top of button 33 to support the table and the semicircular collar will hold on to the main leg 16 to prevent sideways wobble or shift of the table. A table part bar 32 is telescopically received in the main leg 16 and secured by a push button 33 which is a spring biased pin connecting the main leg 16 and the table part bar 32. A pair of legs 28, 28 is pivotably connected to the main leg 16 at a pivot member 26.

The pair of legs 28, 28 are connected to the seat 20 by pivot members 22, and thereby supports a distal end of the seat 20. A proximal end of the seat 20 is connected to the main leg 16 by an attachment element 18 which is slidably mounted on the main leg 16.

Figure 2:
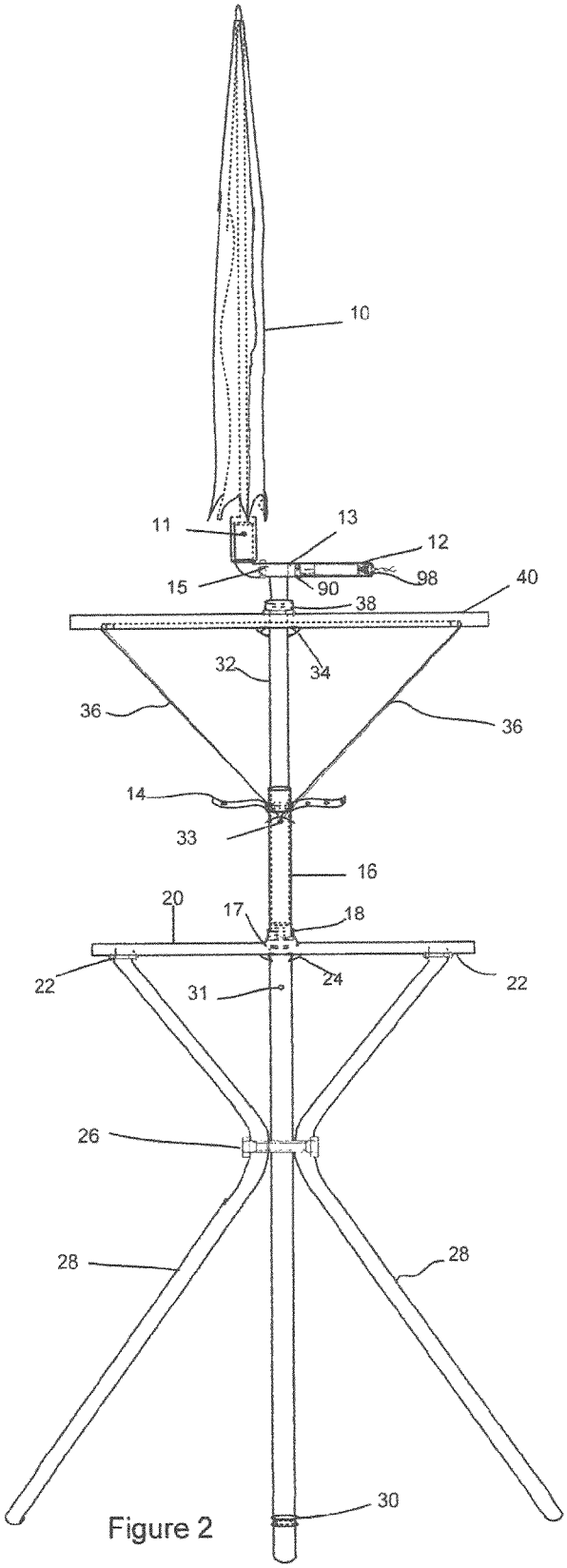
FIG. 2 is a front elevational view of the weather integrated cane workstation of FIG. 1.

In FIGS. 1 and 2, the umbrella 10 is mounted on a cane handle 12. A spring-biased push button 11 extends through a hole 21 (seen in FIG. 3) on the umbrella handle, to lock the umbrella when pushing the umbrella handle onto the rotational part of the cane handle 131. This secures the umbrella mount in a manner shown in FIGS. 9-12 and as discussed further hereunder. Other methods of attaching the umbrella 10 to the cane handle 12 are contemplated as being within the scope of the present invention, and would be understood by anyone having skill in the fastener arts or the mechanical assembly arts. All such variations are contemplated as being within the scope of the present invention.

The details of the parts of the cane handle 12 and their relative locking by a push button 15 are described in FIGS. 9, 10, 11 and 12. An umbrella tying device 14 is shown in its released state in FIG. 1. The umbrella tying device 14 has two flexible arms, including a button on one arm and several holes on the other arm that allows for tightness adjustment. An alternative fastener arrangement could use a snap fastener of known type, or a hook-and-loop by of fastener material. All such variations are contemplated as being within the scope of the present invention.

In use when moving or traveling with the weather integrated cane workstation or the weather integrated cane chair of the present invention, the tip of the umbrella 10 is secured by the umbrella holding device 30 and the umbrella handle is secured by the umbrella tying device 14 so that it is stably connected to the main leg 16. The umbrella holding device 30 is fixed on the main leg 16. The seating platform 20 is connected to the main leg 16 by a connector 18 and connected to the other two legs 28 by the pivot members 22. When folding the chair, the attachment element 18 will slide up on the main cane bar 16. When unfolding the chair, element 18 will slide down and is stopped by ring 17. Ring 17 is fixed to (or part of) the main leg 16. It is positioned so that when element 18 sits on top of it, the seating platform 20 will rest horizontally. Ring 17 helps to support the body weight when the user sits on the seating platform 20.

An axle member 26, which can be a bolt or other connector allowing pivoting motion, holds the main leg 16 and the pair of legs 28, 28 together at a pivoting joint and allows them to rotate against each other to fold or open the chair. A firm, yet flexible, seating-platform-securement device 24 is affixed to the seating platform 20. The securement device 24 is used to securely attach the seating platform 20 to the main cane bar 16 when the chair is in the folded or collapsed position. The securement device 24 can be a band with two arms, similar to that described hereinabove with reference to the umbrella holding device 30, including a button on one arm and several holes on the other arm that allows for tightness adjustment. An alternative fastener arrangement could use a snap fastener of known type, or a hook-and-loop by of fastener material. All such variations are contemplated as being within the scope of the present invention.

The main leg 16 has two holes 31 (shown in FIGS. 1, 2, 5, and 6) and 39 (shown in FIGS. 3, 4, 5, and 6) for snap-locking operation with a push button 33 inside the table part bar 32 to lock the table part bar 32 in the pushed in or pulled out position when moving the table part bar 32 against the main leg 16. The table part bar 32 has guiding grooves 35 on both sides to guide the table part bar 32 during movements inside the main leg 16. The cane handle 12 is attached to the top of the table part bar 32 (shown in FIGS. 1, 2, 3, and 4) of the cane workstation or on the top of the main leg bar 16 of the cane chair (shown in FIGS. 13, 14, 15, and 16).

The table portion 40 is shown in its open horizontal position in FIG. 1 being supported by the table part bar 32 through a connecting device 38 and a triangular steel bar 36. The connecting device 38 does not move relative to the table part bar 32, but allows the table portion 40 to rotate toward or away from table part bar 32. A connecting device 37 is disposed beneath the table portion 40 at a distal end of the table portion 40 from the connecting device 38. The connecting device 37 is generally cylindrical and has a hollow interior, and holds one side of the triangular steel bar 36 to allow the steel triangle to rotate toward or away from the table 40. Other types of connecting devices could be used for the connecting device 37, such as a flat plate deformed to have a half-cylindrical depression, as well as other shapes which can retain the triangular steel bar 36 while permitting pivoting movement.

The two ends of a steel wire or bar 36 are joined together to form the tip of the triangle. The ends then fan out after the joint and form a semicircular collar. When the tip end of device 36 rests on top of the push button 33, the collar will rest on the main leg 16 and will not allow sideways movement of table 40.

The flashlight component 98 is in fully plugged-in position inside the non-rotating part of the cane 12. The flashlight component 98 plugging-guide-groove 100 is inside the cane's non-rotating part handle 12. The groove 100 guides the fin 70 outside of the shell 68 of the flashlight assemble in a pre-determined angle and the push button 90 locks the assembly in position through a hole opening 77 on the non-rotating part 122 of the cane handle 12. The pre-determined angle is adjusted to shine the light on the workstation table 40 when in open position.

FIG. 2 is a front elevational view of the weather integrated cane workstation of FIG. 1, and the parts shown therein are as described hereinabove. The flashlight component 98 is in fully plugged-in position inside the non-rotating part of the cane 12. The spring-biased push button 90 is in the locked position.

Figure 3:
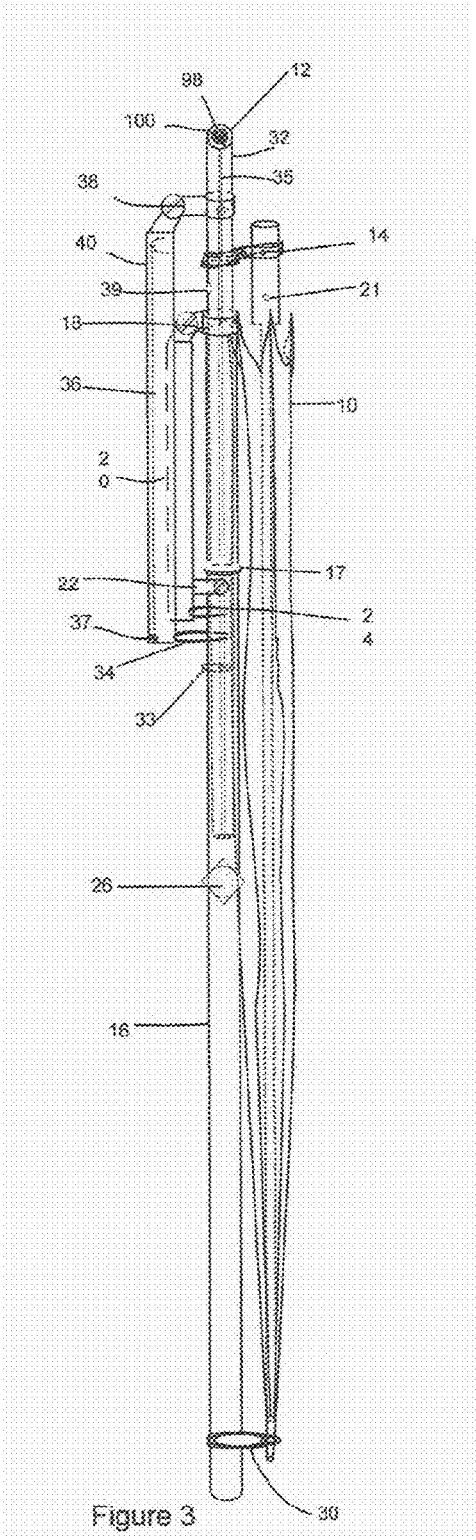
FIG. 3 is a side elevational view of the weather integrated cane workstation showing the left side of the weather integrated cane workstation in a folded condition, according to the present invention.

FIG. 3 is a side elevational view of the weather integrated cane workstation showing the side of the weather integrated cane workstation in a folded condition. The parts shown therein are as described hereinabove. Here, the umbrella 10 is shown secured in its closed position with the tip down and secured at that tip by the umbrella holding device 30, and secured at the other end by the umbrella tying device 14. The flashlight component 98 is in fully plugged-in position inside the non-rotating part of the cane 12. The flashlight component 98 plugging guide groove 100 is inside the cane's non-rotating part handle 12.

FIG. 4 is a front elevational view of the weather integrated cane workstation of FIG. 3, showing the weather integrated cane workstation in the folded condition. The parts shown therein are as described hereinabove. The flashlight component 98 is in fully plugged-in position inside the non-rotating part of the cane 12. The spring-biased push button 90 is in the locked position.

In FIGS. 3 and 4, the workstation is shown in its folded form. The umbrella 10 is collapsed and, as noted above, is attached to the main cane bar 16 by the umbrella hold device 30 and the umbrella-tie device 14. The rotation part of the cane handle 12 is shown locked in a downward position for easy cane movement, i.e. for use as a cane. The hole 21 shown on the umbrella handle in FIG. 3 is the opening for the push button 11 when mounting the umbrella. The push button 33 is in the locked position through the opening or hole 31. The table portion 40 is collapsed on top of the seat 20 with the steel wire 36 being disposed between the table 40 and the seat 20.

Figure 5:
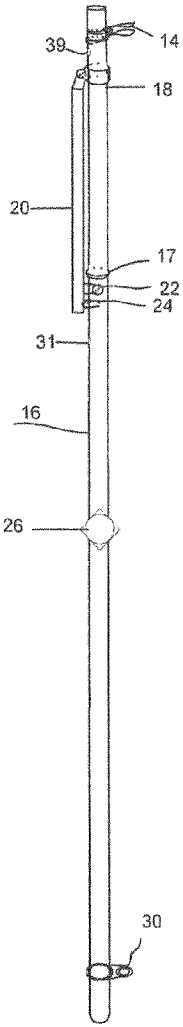
FIG. 5 is a side elevational view of the seating portion of the weather integrated cane workstation of FIG. 3, wherein the seating portion is in a folded position and is shown by itself for the sake of clarity.

FIG. 5 is a side elevational view of the seating portion of the weather integrated cane workstation of FIG. 3, wherein the seating portion is in a folded position and is shown by itself for the sake of clarity. The parts shown therein are as described hereinabove.

Figure 6:
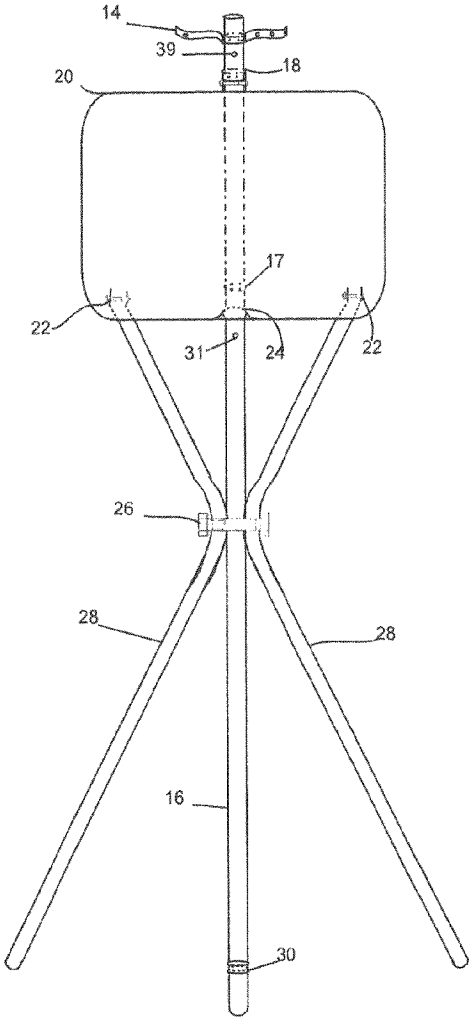
FIG. 6 is a front elevational view of the seating portion of the weather integrated cane workstation of FIG. 5, wherein the seating portion is in a folded position and is shown by itself for the sake of clarity.

FIG. 6 is a front elevational view of the seating portion of the weather integrated cane workstation of FIG. 5, wherein the seating portion is in a folded position and is shown by itself for the sake of clarity. The parts shown therein are as described hereinabove.

Figure 7:
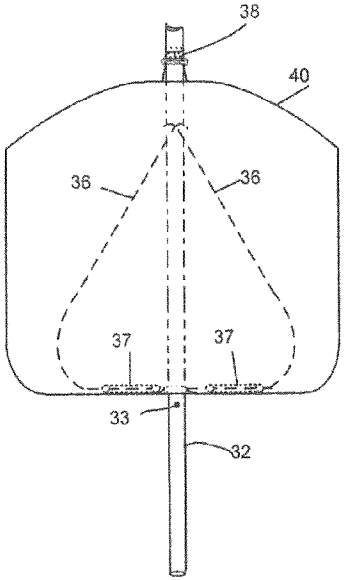
FIG. 7 is a front elevational view of the table portion of the weather integrated cane workstation of FIG. 3, wherein the table portion is in a folded position and is shown by itself for the sake of clarity.

FIG. 7 is a front elevational view of the table portion of the weather integrated cane work-station of FIG. 3, wherein the table portion is in a folded position and is shown by itself for the sake of clarity. The parts shown therein are as described hereinabove.

Figure 8:
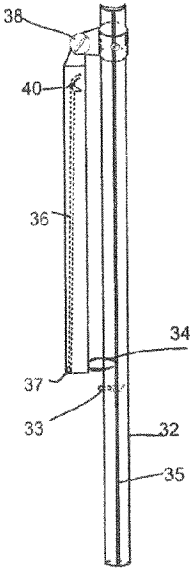
FIG. 8 is a side elevational view of the table portion of the weather integrated cane workstation of FIG. 7, wherein the table portion is in a folded position and is shown by itself for the sake of clarity.

FIG. 8 is a side elevational view of the table portion of the weather integrated cane work-station of FIG. 7, wherein the table portion is in a folded position and is shown by itself for the sake of clarity. The parts shown therein are as described hereinabove.

Figure 9:
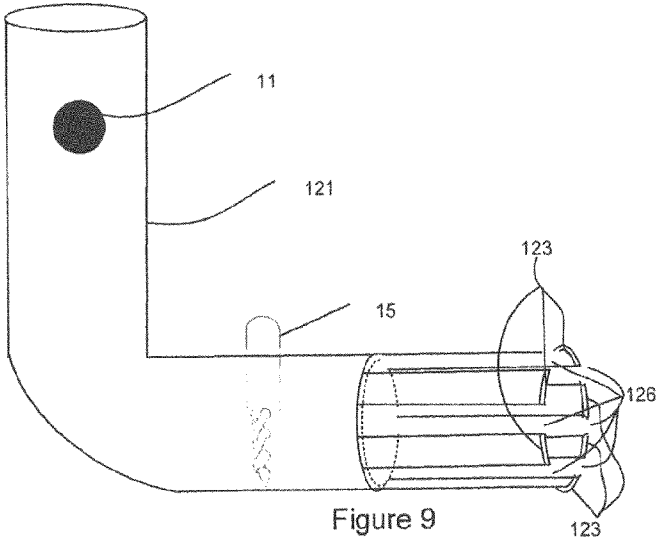
FIG. 9 is a side view in perspective showing a rotatable umbrella support portion of the cane handle portion of the device shown in FIGS. 1-4.

FIG. 9 is a side view in perspective showing a rotatable umbrella support portion of the cane handle portion of the device shown in FIGS. 1-4. As shown in FIG. 9, the rotating part 121 of the cane handle 12 is shown by itself. The non-rotating part 122 of the cane handle 12 is shown by itself in FIG. 10. The push button 11 is shown as a darkened circle because it is pointing out of the paper. The push button 15 is shown in its relaxed (extended) position. It is positioned 90 degrees relative to the push button 11.

The part 121 has a plurality of tines or arms terminating at distal ends 123. The distal ends 123 respectively bend at the end of the rotating part 121 of the cane handle 12 so as to lock the rotating and non-rotating parts of the handle together. A plurality of cut openings 126 are disposed between the arms and so define them. These cut openings 126 provide for flexibility when pushing the rotating part 121 into the non-rotating part 122 of the cane handle 12. The cuts will allow it to squeeze through a lock-ring 13 that is fixed inside the non-rotating part 122 of the handle.

Figure 10:
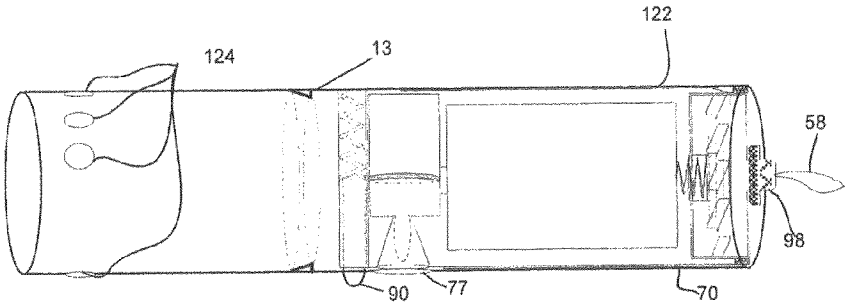
FIG. 10 is a side perspective view of a non-rotating portion of the cane handle portion of the device shown in FIGS. 1-4, and which supports and houses the rotatable umbrella support portion of FIG. 9, and it also is a shell to house the flashlight assembly of FIG. 21.

FIG. 10 is a side perspective view of a non-rotating portion 122 of the cane handle portion of the device shown in FIGS. 1-4, and which supports the rotatable umbrella support portion of FIG. 9. As seen in this view, the portion 122 has a plurality of hole openings 124 therein, any of which can receive the push button or pin 15. This enables the relative rotational position to be changed between the portion 121 of FIG. 9 and the portion 122 of FIG. 10.

In FIG. 10, the lock-ring 13 is fixed inside the non-rotating part 122 of the cane handle. The lock-ring 13 has a slope on one side to allow for the rotating part 121 of the cane handle 12 to enter and squeeze through when integrating the two parts 121 and 122.

In FIG. 10 the flashlight component is plugged into the non-rotating part 122 of the cane in a fixed angle by following a groove inside of the cane handle 122. There is a hole 77 opening on the non-rotating part 122 of the cane that lets the light shine through when it is turned on. The hole 77 is cut in an angle adjusted to let the light shine on the workstation tray when it is in the open position. The flashlight component 98 is secured by a spring-biased push button 90 when it is in lock position. It can be easily pulled out by pulling the string 58 at the end of the flashlight component while push in the spring-biased push button 90 to unlock the component.

Figure 11:
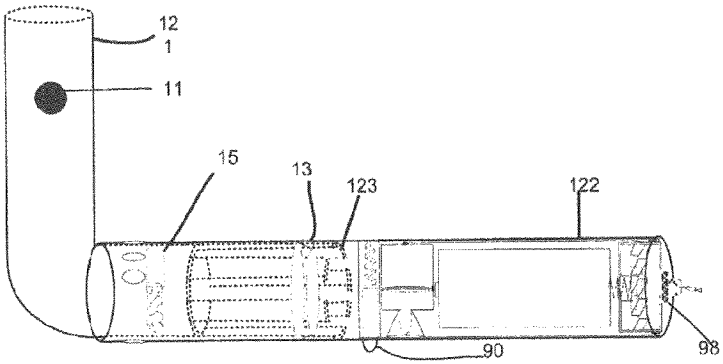
FIG. 11 is a side perspective view of the integrated cane handle when the rotatable umbrella support portion of FIG. 9 is pushed all the way into the non-rotating portion of the cane handle portion shown in FIG. 10, when the rotatable umbrella support portion is being rotated and therefore is not yet set in a fixed position; the non-rotating portion of the cane also shows the flashlight assembly plugged-in as shown in FIG. 10.

FIG. 11 is a side perspective view of the integrated cane handle when the rotatable umbrella support portion 121 of FIG. 9 is pushed all the way into the non-rotating portion 122 of the cane handle portion shown in FIG. 10, wherein the pin 15 remains retracted when the rotatable umbrella support portion is being rotated and therefore is not yet set in a fixed position.

FIG. 11 shows that there is enough room for the handle rotating part 121 to push in against the handle non-rotating part 122 with the push button 15 in a compressed state. The user can then rotate to select an angle and pull the rotating part 121 of handle 12 out to allow the push button 15 to lock into the selected opening hole 124.

FIG. 11 shows the flashlight component 98 plugged in the non-rotating part 122 and is locked by the spring-biased push button 90.

Figure 12:
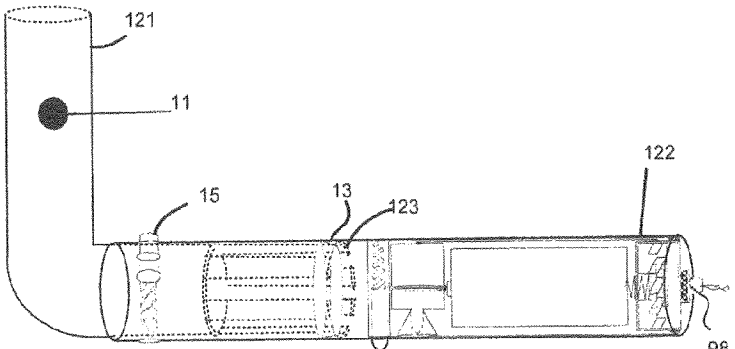
FIG. 12 is a side perspective view of the integrated cane handle as shown in FIG. 11, when the rotatable umbrella support portion of FIG. 9 is pushed into the non-rotating portion of the cane handle portion shown in FIG. 10, wherein the rotatable umbrella support portion is set in a fixed position by a spring-loaded movable push button which in its extend position serves as a locking pin, and wherein the non-rotating portion of the cane also shows the flashlight assembly plugged-in as shown in FIG. 10.

FIG. 12 is a side perspective view of the integrated cane handle as shown in FIG. 11, when the rotatable umbrella support portion 121 of FIG. 9 is pushed almost all the way into the non-rotating portion 122 of the cane handle portion shown in FIG. 10, wherein the rotatable umbrella support portion is set in a fixed position by the spring-loaded movable push button 15 which in its extend position serves as a locking pin.

FIG. 12 shows the bent edge 123 of the rotating part 121 against the vertical edge of the lock-ring 13, which will not allow the rotating part of the handle 121 to be pulled out from the non-rotating part 122 of the handle 12.

FIG. 12 shows the flashlight component 98 plugged in the non-rotating part 122 and is locked by the spring-biased push button 90.

FIG. 13 is a side elevational view of the weather integrated cane chair similar to that shown in FIG. 1 hereinabove but without a table, this view showing the left side of the weather integrated cane chair in an operational position. The parts shown are similar to those described hereinabove with reference to FIGS. 1-12. The cane handle 12 is attached to the top of the main bar 16.

Figure 14:
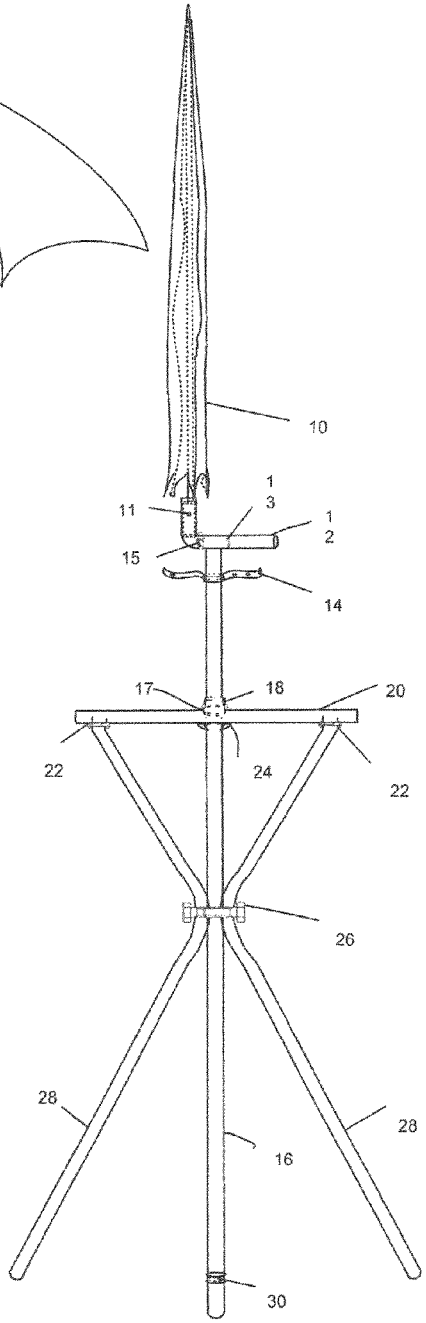
FIG. 14 is a front elevational view of the weather integrated cane chair of FIG. 13.

FIG. 14 is a front elevational view of the weather integrated cane chair of FIG. 13. The parts shown are similar to those described hereinabove with reference to FIGS. 1-12.

Figure 15:
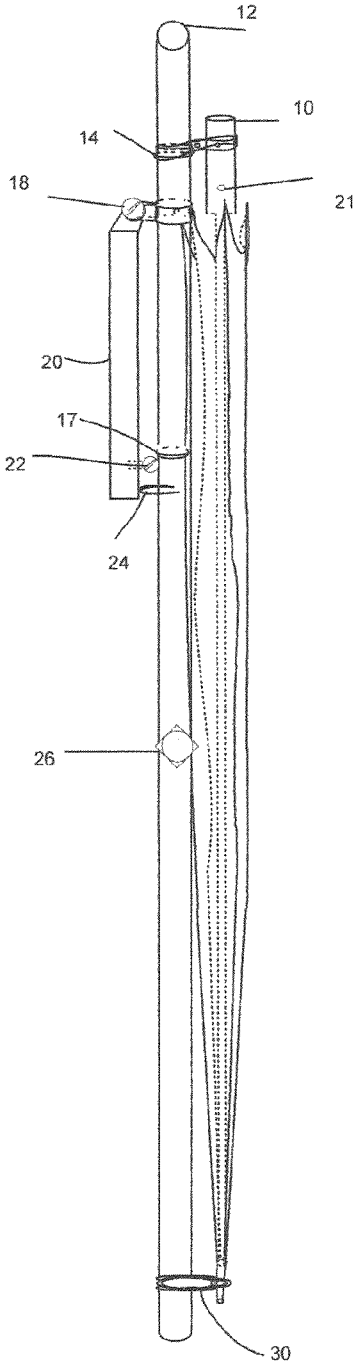
FIG. 15 is a side elevational view of the weather integrated cane chair showing the left side of the weather integrated cane chair in a folded condition, according to the present invention.

FIG. 15 is a side elevational view of the weather integrated cane chair showing the left side of the weather integrated cane chair in a folded condition. The parts shown are similar to those described hereinabove with reference to FIGS. 1-12.

FIG. 16 is a front elevational view of the weather integrated cane chair of FIG. 15, showing the weather integrated cane chair in the folded condition. The parts shown are similar to those described hereinabove with reference to FIGS. 1-12.

Figures 1, 17A, 17B, 17C, 17D, 17E, 18A, 18B:
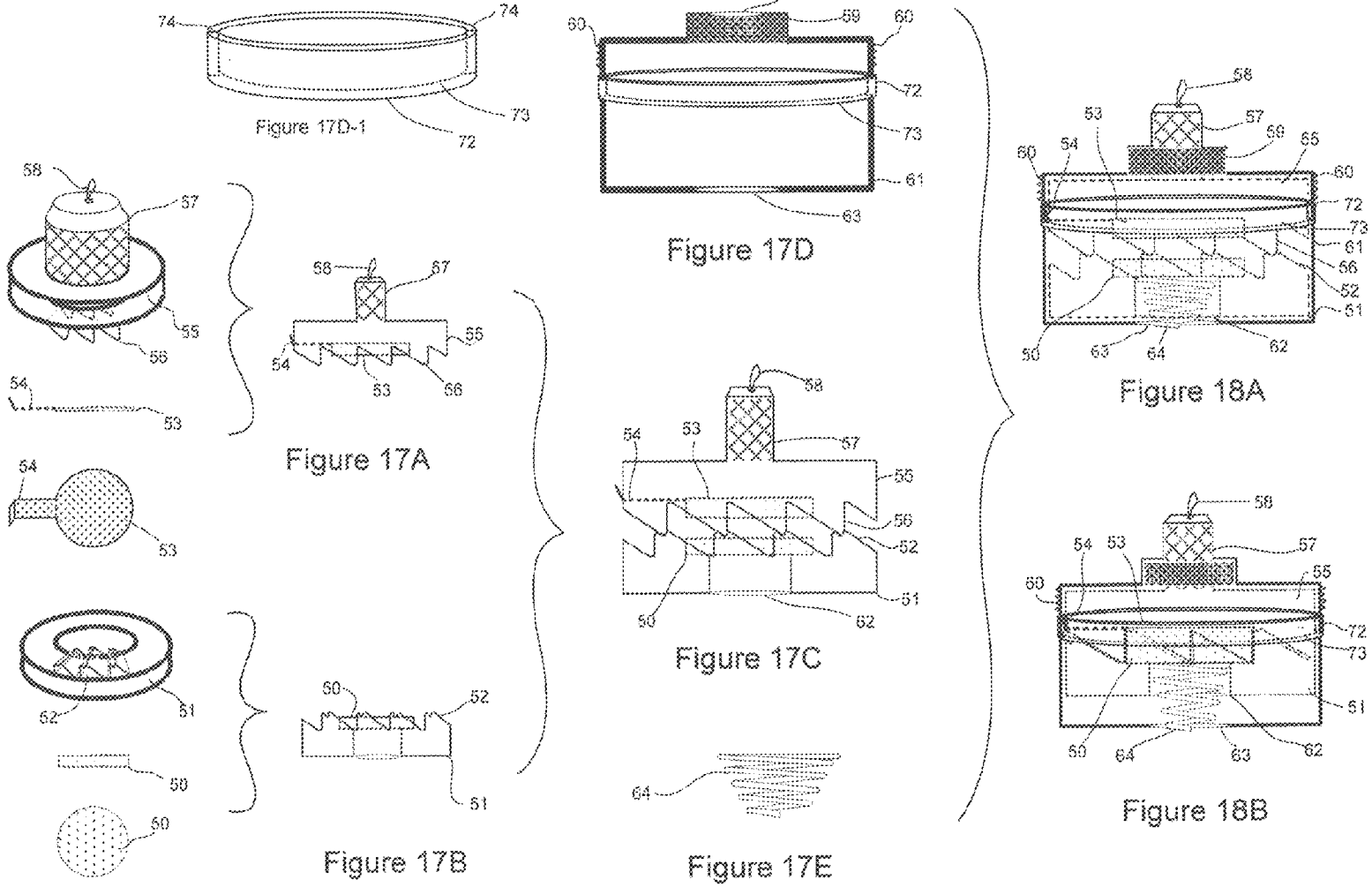
FIGS. 17A, B, C, D, E show all the elements of the flashlight on-off controlling parts.
FIGS. 18A, B shows the assembly of the flashlight on-off controlling gear box.

FIGS. 17A-D show all the details of the flashlight on-off controlling gear parts. FIG. 17A shows that the rotating part of the gear 55 is made up of a rotation handle 57, a ring of teeth 56, an electricity conductor 53, and a string 58. String 58 can be used to pull the flashlight assembly 98 out from the non-rotating part 122 of the cane shown in FIGS. 10, 11, and 12. The teeth 56 are for pushing the non-rotating part of the gear 51 down when turning the handle 57 (clockwise due to teeth slant orientation) and rubbing against the teeth 52 of the non-rotating part of the gear 51. The conductor 53 has a conducting arm 54. The elements 53, 54 are implanted in the middle of the rotating part of the gear 55. The arm 54 will touch the flashlight electricity conductor ring 73. FIG. 17B shows that the conductor plate 50 is implanted in the middle of the non-rotating part of the gear 51. The none-rotating part of the gear 51 has a hole in the middle allowing a conducting spring 64 to contact plate 50 and pushing non-rotating gear part 51 up against rotating part 55. All of teeth 52 of the gear part 51 have a dip on the top to allow for teeth 56 to rest. The flashlight is turned off while the teeth 51 & 56 are in this rest status. FIG. 17C displays the gears parts in this rest position. FIG. 17D shows the gear box 61 that encloses the gear parts 55 and 51. It has opening 65 on top for rotation handle 57, opening 63 to allow for spring 64 expansion and compression movements, and a double metal ring plates 72, 73 connected by two connectors 74. Ring 73 encircles the inside the wall of gear box 61 wall and ring 72 encircles the outside of the gear box 61 wall. When turning handle 57, the rotating gear part 55 will rotate and the arm 54 brushes against ring to keep the contact and form electricity loop. The detail structure of ring 72 and 73 and their connectors are shown by FIG. 17D-1.

FIGS. 18A,B show the flashlight on-off controlling gear box assemblies. FIG. 18A shows the gear parts in "off" position and FIG. 18B shows the gear parts in "on" position. The assembly includes the gear box 61, the rotatable gear 55, the non-rotatable gear 51 and the conducting spring 64. The gear box 61 has a handle 59 with a round opening 65 and some screw tracks 60. The gear box can be secured against the flashlight assembly shell 68 of FIG. 20 by rotating the handle 59 and the screw tracks can tight against the screw tracks 66 inside of the flashlight component shell 68. When completely screwed in, the ring 72 encircles the outside of the gear box 61 wall is contacted by conducting node 87. When unscrewing and disassembling the gear box 61 and shell 68, it is easy to change the battery 74 and/or the light bulb component 80.

When rotating the handle 57 anti-clockwise, the teeth of the gear parts 55 and 51 will not allow the rotation due to the cut angles of the teeth 56 and 52. When rotating the handle 57 clockwise the teeth 56 of the rotating part of the gear 55 will slide against the teeth 52 of the non-rotating part of the gear 51 and push the non-rotating part of the gear 51 down by pressing the spring 64 therefore to separate the conductor 50 and 53. Since the teeth 56 can rest on middle positions of the teeth 52, the flashlight can stay off in this position. When rotating element 57 further, the spring 64 will push two parts of the gear 55 and 51 together and the conductors 53 and 50 will contact each other to complete the electricity loop and the flashlight will stay on. The spring 64 is conductive to allow this electricity loop closed.

Figure 19:
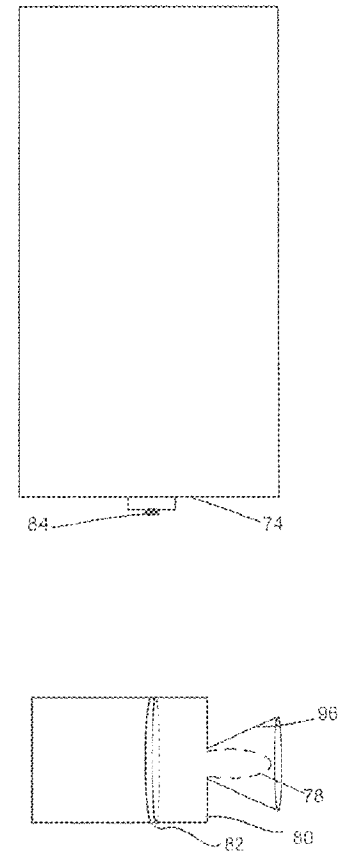
FIG. 19 shows the battery, the light head assembly, and the current connector.

FIG. 19 shows the battery 74 and flashlight head 80. The flashlight head has a special conducting ring 82 so that the cathode 84 of the battery 74 can make contact and complete the electricity loop. The light bulb and light reflector 96 are shown to express the idea. There are advanced LED light bulbs available on the market that can shine brightly and evenly through a hole opening onto a large surface in a close range.

Figure 20:
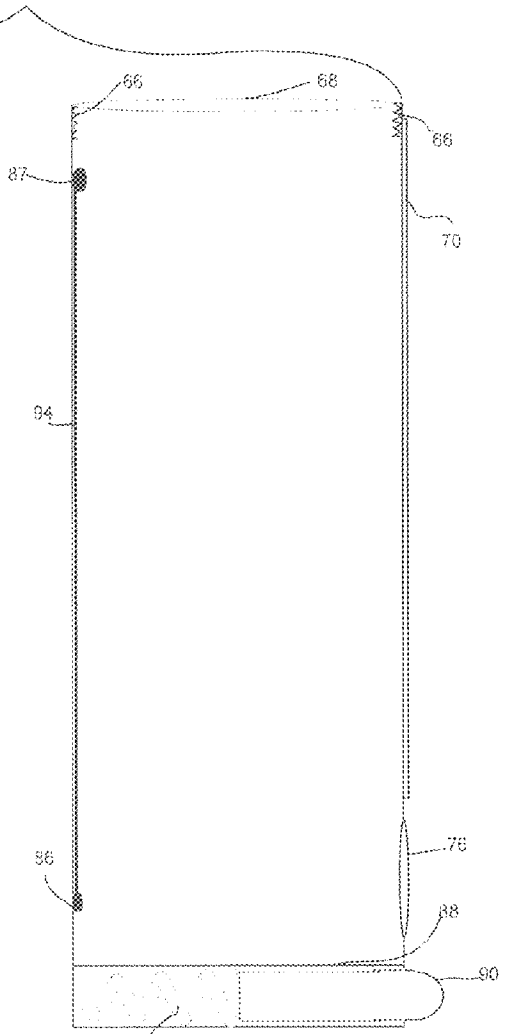
FIG. 20 shows the case that houses the flashlight component. The case has an outside fin that helps to guide positioning the component.

FIG. 20 is the flashlight component shell 68 case. It has screw tracks 66 that can hold the flashlight on-off controlling gear box assembly 61. A long metal conducting plate 94 is attached to the shell 68 with two nodes 87, 86 on each end. Node 87 is to make contact with ring 72 and node 86 is to keep contact with the light bulb 80. Shell 68 has a small fin 70 outside the case that will fit the groove 100 inside the non-rotating part 122 (FIG. 10) of the cane handle 12 (FIG. 1). The hole opening 76 is to allow the flashlight to shine through. The compartment 88 houses a spring-biased push button 90. This button 90 is to lock the flashlight component in a secured position against the non-rotating part 122 (FIG. 10) of the cane handle 12 (FIG. 1). The orientation will be adjusted to the best angle for cane operation when manufacturing the product.

Figure 21:
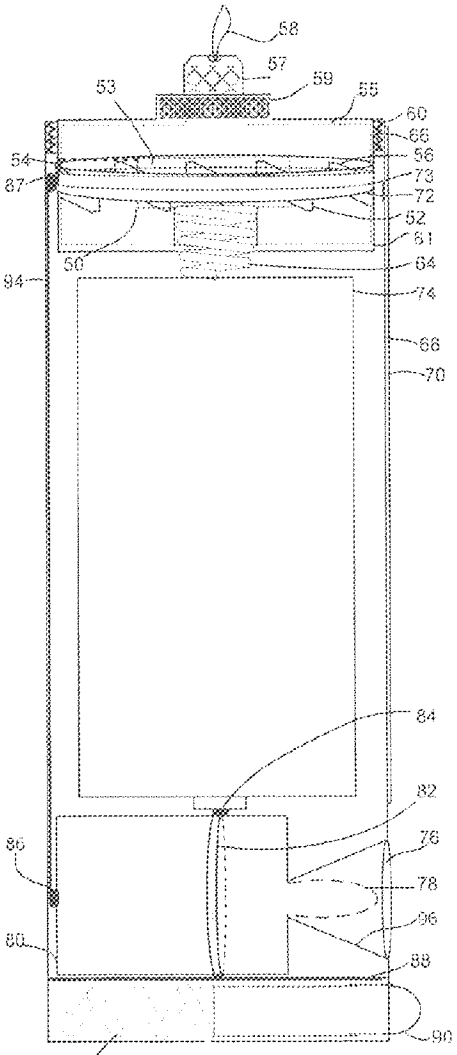
FIG. 21 shows the fully assembled flashlight component.

FIG. 21 is the complete assembly of the flashlight component. The details of the functionalities of each of the elements are described in the FIGS. 17-20 descriptions above.

The relative dimensions shown in the drawings and/or set forth above are by way of example only, and these dimensions can vary without departing from the scope of the present invention.

The invention being thus described, it will be evident that the same may be varied in many ways. Such variations are not to be regarded as a departure from the spirit and scope of the invention and all such modifications are intended to be included within the scope of the claims.

What is claimed is:

1. A foldable workstation having a seat and table, which has a folded condition and an unfolded condition, and which can serve as a workstation in the unfolded condition and which can serve as a cane in the folded position, comprising:

a main leg having an upper portion and a lower portion;

a telescoping bar received in said upper portion of said main leg, said telescoping bar having a proximal end portion disposed inside said upper portion of said main leg and having a distal end portion;

a push button for releasing said telescoping bar for movement relative to said upper portion of said main leg;

a pair of legs disposed on opposite sides of said main leg, said pair of legs having an intermediate portion which is pivotably connected to an intermediate portion of said main leg;

a stop ring fixedly connected to said upper portion of said main leg, an attachment element slidably mounted on said main leg, said attachment element being stopped from moving by contact with said stop ring;

a foldable seat portion having a distal end pivotably connected to one end of said pair of legs, said foldable seat portion having a proximal end connected to said attachment element; said attachment element being in contact with said stop ring when said foldable seat portion is in the unfolded condition;

a foldable table portion having a proximal end pivotably connected to said upper portion of said main leg, said foldable table portion having a distal end; said foldable table portion forms a table in the unfolded condition;

a triangular bar member having a tip and a base, said base being pivotably connected to said distal end of said foldable table portion; in said folded condition said triangular bar member lying against said foldable table portion and in said unfolded condition said tip of said triangular bar member abutting said upper portion of said push button and abutting said main leg such that said tip of said triangular bar member supports said foldable table portion against movement;

a cane handle supported by said distal end portion of said telescoping bar;

said cane handle having a first part and a second part, said first part having a plurality of arms terminating at distal ends, wherein said distal ends respectively are bent outwardly; and said first part of said cane handle having a handle push button having an extended position and a retracted position; and said second part of said cane handle having a cane handle ring receiving the distal ends of the plurality of arms such that the distal ends of the plurality of arms lock said cane handle ring in place against relative axial movement between said first part of said cane handle and said second part of said cane handle due to the outward bending of the distal arms; and said second part of said cane handle having a plurality of holes to receive said handle push button in its extended position to secure said first part of said cane handle and said second part of said cane handle against relative rotation;

an adjustable support member mounted on said cane handle, and an umbrella mounted on said adjustable support, wherein said umbrella is supported by said adjustable support so as to be adjustably positionable relative to said cane handle, and wherein said umbrella in the unfolded condition extends above said foldable table portion;

a flashlight assembly that is disposed in and supported by said non-rotating part of said cane handle in fixed orientation relative thereto, and wherein said flashlight assembly has an ON condition in which said flashlight assembly provides light to said foldable table portion when said foldable table portion is in the unfolded condition;

whereby the workstation has the folded position which renders it portable and easy to stow, has the unfolded condition wherein the workstation includes said seat and said table, and has the folded condition wherein said cane handle and said main leg form a cane whereby a user can use the workstation as a cane when the workstation is in the folded condition.

2. The device of claim 1, further comprising a connector fixed to said main leg, and wherein said umbrella has a folded position and an unfolded position, and wherein in said folded position, said umbrella is oriented downwardly and is secured by said connector fixed to said main leg.

* * * * *